US009466316B2

(12) United States Patent
Christian

(10) Patent No.: US 9,466,316 B2
(45) Date of Patent: Oct. 11, 2016

(54) DEVICE, METHOD AND SYSTEM FOR INSTANT REAL TIME NEURO-COMPATIBLE IMAGING OF A SIGNAL

(71) Applicant: Otosense Inc., Cambridge, MA (US)

(72) Inventor: Sebastien J. V. Christian, Somerville, MA (US)

(73) Assignee: OtoSense Inc., Cambridge, MA (US)

( * ) Notice: Subject to any disclaimer, the term of this patent is extended or adjusted under 35 U.S.C. 154(b) by 0 days.

(21) Appl. No.: 14/615,290

(22) Filed: Feb. 5, 2015

(65) Prior Publication Data

US 2015/0221190 A1 Aug. 6, 2015

Related U.S. Application Data

(60) Provisional application No. 61/936,706, filed on Feb. 6, 2014.

(51) Int. Cl.

| | |
|---|---|
| ***G08B 21/00*** | (2006.01) |
| ***G10L 25/27*** | (2013.01) |
| ***G08B 21/18*** | (2006.01) |
| ***G08B 1/08*** | (2006.01) |
| ***G10L 25/48*** | (2013.01) |

(Continued)

(52) U.S. Cl.

CPC ..... *G10L 25/27* (2013.01); *G08B 1/08* (2013.01); *G08B 17/10* (2013.01); *G08B 21/18* (2013.01); *G10L 21/14* (2013.01); *G10L 25/48* (2013.01); *G10H 2210/301* (2013.01)

(58) Field of Classification Search

CPC .. G08B 1/08; G10H 2210/301; G10H 17/00; G06F 3/16

USPC ..... 340/540; 84/626, 464 R, 662; 345/440.1; 367/7; 381/56

See application file for complete search history.

(56) References Cited

U.S. PATENT DOCUMENTS

| | | | |
|---|---|---|---|
| 6,046,724 | A | 4/2000 | Hvass |
| 6,240,392 | B1 | 5/2001 | Butnaru et al. |
| 7,126,467 | B2 | 10/2006 | Albert et al. |

(Continued)

FOREIGN PATENT DOCUMENTS

| | | |
|---|---|---|
| EP | 1991128 | 4/2012 |
| EP | 2478836 | 7/2012 |
| WO | WO 2013/113078 | 8/2013 |

OTHER PUBLICATIONS

International Search Report for International Application PCT/US2015/014669, dated May 18, 2015.

*Primary Examiner* — John A Tweel, Jr.

(74) *Attorney, Agent, or Firm* — Park, Vaugahn, Fleming & Dowler LLP

(57) ABSTRACT

A method, apparatus and system for transforming a progressing sound signal into a progressing visual pattern, the progressing visual pattern being perceptible and recognizable as the progressing sound signal to a user in real time. The progressing visual pattern displays in real time a set of optical attributes, the set of optical attributes being transformations from a set of sound features that define the sound signal in real time. The sound features and optical attributes, along with changes in the sound features and optical attributes over time, are preselected to be isomorphic to sound, perceptible to human vision, efficiently processed by human cognition, and therefore to be recognizable to a human who has been exposed and actively or passively trained to it.

32 Claims, 6 Drawing Sheets

(51) Int. Cl.
*G10L 21/14* (2013.01)
*G08B 17/10* (2006.01)

(56) References Cited

U.S. PATENT DOCUMENTS 7,129,833 B2 10/2006 Albert
7,173,525 B2 2/2007 Albert
7,391,316 B2 6/2008 Albert et al.
8,247,677 B2 8/2012 Ludwig
8,309,833 B2 11/2012 Ludwig
8,440,902 B2 5/2013 Ludwig
8,488,820 B2 7/2013 Pedersen
8,540,650 B2 9/2013 Salmi et al.
8,546,674 B2 10/2013 Kurihara et al.
8,781,301 B2 * 7/2014 Fujita ..... G06F 17/30787 386/248
2008/0085741 A1 4/2008 Tauberman et al.
2008/0276793 A1 11/2008 Yamashita et al.
2011/0283865 A1 11/2011 Collins
2012/0113122 A1 5/2012 Takazawa et al.
2013/0215010 A1 8/2013 Hermodsson

* cited by examiner

| 300 | 350 | 400 |
|---|---|---|
| SOUND FEATURE (300) | PRE-SELECTED VALUE (350) | OPTICAL ATTRIBUTE (400) |
| VOLUME | LOG OF AVERAGED POWER SPECTRUM OF THE SOUND SIGNAL | AREA OF CIRCLE AS DEFINED BY RADIUS |
| VOLUME | INVERSE OF LOG OF AVERAGED INTENSITY OF THE SOUND SIGNAL | LEVEL OF TRANSPARENCY |
| PITCH | LOG OF THE AVERAGED FREQUENCY SPECTRUM OF THE SOUND SIGNAL | POSITION OF POLYGON VERTEX (ANGLE AND LINEAR DIMENSION) |
| RHYTHMICITY | FIRST DERIVATIVE OF THE LOG OF THE AVERAGED INTENSITY OF THE SOUND SIGNAL | COLOR PATTERN SPATIAL FREQUENCY |
| 305 | 355 | 405 |

FIG. 4

DEVICE, METHOD AND SYSTEM FOR INSTANT REAL TIME NEURO-COMPATIBLE IMAGING OF A SIGNAL

CROSS-REFERENCE TO RELATED APPLICATION

This application claims priority to, and the benefit of, co-pending U.S. Provisional Application No. 61/936,706, filed Feb. 6, 2014, for all subject matter common to both applications. The disclosure of said provisional application is hereby incorporated by reference in its entirety.

FIELD OF THE INVENTION

The present invention relates to the field of transforming sound into a sensory stimulus that need not utilize audition. The stimulus can be suitable for affecting the safety, security and comfort of individuals with compromised hearing or with a need for hearing enhancement, for example. In particular, the present invention relates to a device, method, and system for transforming a progressing sound signal into a progressing visual pattern in real time and displaying a perceptible and recognizable visual representation of the progressing sound signal in real time on a visual display.

BACKGROUND

Generally, the inability to translate auditory stimulae into stimulae that activate non-auditory senses limits access to and use of sound signals. For example, the sensory inaccessibility of warning and other action-prompting sounds to individuals with hearing impairment compromises their safety, security and comfort. Current warning devices require connecting a light or vibration device to a sound source or to a user in order to stimulate a user's senses. These devices are based on direct contact between device and source or device and user, or on captors and high-frequency transmitters and receivers to make a distant lamp flash or a pager vibrate, and do so in response to one specific targeted sound, such as a sound emanating from a smoke alarm on a particular smoke detector. Current devices are limited to producing a discrete sensory signal in response to a discrete and periodic sound event and do not transform real time continuous sound information into real time continuous visual information that can interpret complex and progressing sounds. Current devices also do not provide real time perceptible, recognizable and interpretable visualization of these complex and progressing sounds.

SUMMARY

There is a need for a system, device and method of transforming in real time a progressing sound signal into a sensory stimulus, such as a continuously progressing visual pattern, that a user can perceive and recognize in real time without a need to deploy audition and without being constrained to a particular location or a particular sound or type of sound. The present invention is directed toward further solutions to address this need, in addition to having other desirable characteristics. Specifically, according to aspects of the present invention, a system, device, and method provide continuous real time interpretive visualization of a sound signal. The sound signal can be a short, long, static, constant, and/or changing sound signal, as one of skill in the art will appreciate, and can contain at different points in time period and/or aperiodic portions.

An embodiment of the present invention is directed to a method for transforming a progressing sound signal into a progressing visual pattern displayed on a surface over a time duration by executing, on a computing hardware component, an application implementing a plurality of steps. A set of preselected values characterizing a set of preselected sound features is calculated from the progressing sound signal and transforms a set of preselected sound features into a set of preselected optical attributes. The set of preselected sound features are selected so that the progressing sound signal can be reconstructed to be recognizable from the preselected set of sound features. According to aspects of the present invention, the set of preselected optical attributes defines the progressing visual pattern. The computing hardware device causes display of the progressing visual pattern on a surface. The progressing visual pattern is displayed in a form that is isomorphic to sound, perceptible to human vision, can be processed by human cognition, and which is therefore recognizable to a human during the time duration.

An embodiment of the present invention is directed to a device, the device comprising a surface displaying a progressing visual pattern transformed from a progressing sound signal, a computing hardware component, and an application executing on the computing hardware component. The computing hardware component is configured in communication with the surface. The progressing sound signal is transformed into the progressing visual pattern displaying on the surface over a time duration by the application executing on the computing hardware component. A set of preselected values are calculated by the executing application, the set of preselected values characterizing a set of preselected sound features from which the progressing sound signal can be reconstructed to be recognizable. The set of preselected sound features are transformed into a set of preselected optical attributes. The set of preselected optical attributes defines the progressing visual pattern and the progressing visual pattern is displayed in a form that is isomorphic to sound, perceptible to human vision, can be processed by human cognition, and which is therefore recognizable to a human during the time duration.

An embodiment of the present invention is directed to a device comprising a surface displaying a changing visual pattern transformed from a progressing sound signal, a computing hardware component and an application executing on the computing hardware component. The computing hardware component is configured in communication with the surface. Each one of a set of pre-determined values extracted from the progressing sound signal transforms one preselected sound feature of a set of preselected sound features into one pre-selected optical attribute of a set of pre-selected optical attributes, where the set of pre-selected optical attributes defines the progressing visual pattern displayed on the display surface. The progressing visual pattern is displayed in a form that is isomorphic to sound, perceptible to human vision, can be processed by human cognition, and which is therefore recognizable to a human during the time duration.

According to aspects of the present invention, the progressing visual pattern is recognizable by a human who has been exposed and actively or passively trained to the progressing visual pattern.

According to aspects of the present invention, the set of preselected values can transform one of a set of preselected sound features into one of a set of preselected optical attributes and an equivalency between the one preselected sound feature and the one preselected optical attribute can be recognized by a user viewing the display of the progressing visual pattern on the surface.

According to aspects of the present invention, each preselected value in the set of preselected values can transform one of a set of preselected sound features into one of a set of preselected optical attributes and an equivalency between the one preselected sound feature and the one preselected optical attribute can be recognized by a user viewing the display of the progressing visual pattern on the surface.

According to aspects of the present invention, transforming the progressing sound signal into the progressing visual pattern for display occurs in real time. According to aspects of the present invention, the progressing sound signal can comprise an aperiodic portion.

According to aspects of the present invention, one feature of the set of preselected sound features can be a volume quantity and a preselected value associated with the volume quantity can be a perceptible loudness, calculated as a log of the averaged power spectrum of the sound signal over an interval of time.

According to aspects of the present invention, one feature of the set of preselected sound features can be a pitch indication, and a preselected value associated with the pitch indication can be a frequency level, calculated as the log of the average frequency spectrum of the sound signal over an interval of time.

According to aspects of the present invention, one feature of the set of preselected sound features can be a rhythm indication, and a preselected value associated with the rhythm indication can be an intensity variation quantity, calculated as a first derivative of the log of the averaged intensity of the sound signal over an interval of time.

According to aspects of the present invention, one attribute of the set of preselected optical attributes can be a shape indication, and a preselected value associated with the shape can define a linear dimension. According to aspects of the present invention, one attribute of the set of optical attributes can be a transparency indication, and a preselected value associated with the transparency indication can define a level of transparency.

According to aspects of the present invention, the surface can comprise one or more surface of a plurality of surfaces selected from the group consisting of a flat panel display, a liquid crystal display, a diode array display, a display screen, a mobile phone surface, a personal computer surface, a surface of a helmet, a visor, a pair of glasses, an apparatus for engaging an infant, or any other type of display surface that can be oriented in view of a user.

According to aspects of the present invention, the computing hardware device can include one or more device of a plurality of devices selected from the group consisting of a mobile phone, a personal computer, a helmet, a visor, a pair of glasses, a display screen, a display surface, and an apparatus for engaging an infant.

According to aspects of the present invention, the progressing visual pattern can be displayed on the surface in real time.

According to aspects of the present invention, the device can be a distributed device, the distributed device having components that may be separated by physical distances from each other.

BRIEF DESCRIPTION OF THE FIGURES

These and other characteristics of the present invention will be more fully understood by reference to the following detailed description in conjunction with the attached drawings, in which:

FIG. 4 provides a list of examples of preselected sound features, preselected optical attributes, and a list of preselected values, each one preselected value characterizing formulaically a sound feature, according to aspects of the present invention progressing sound;

DETAILED DESCRIPTION

Figure 1:
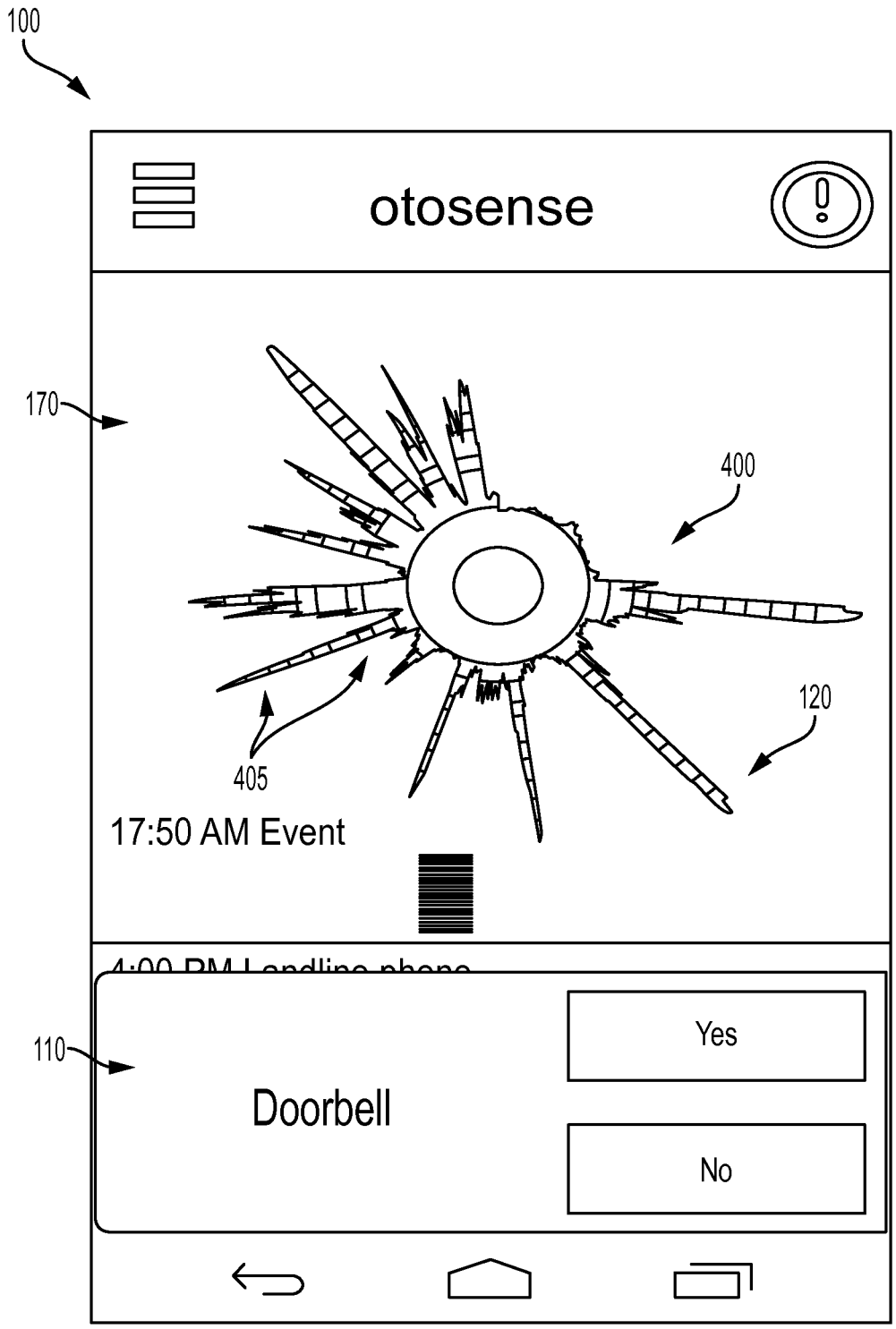
FIG. 1 provides an illustrative example of a snapshot of a progressing visual pattern, in this example, the progressing visual pattern representing the dynamic sound of a specific doorbell, where the snapshot is displayed on a screen of a mobile device, according to aspects of the present invention.

An illustrative embodiment of the present invention relates to a system, device and method for continuous real time interpretive display and visualization of a sound signal. A changing, or static, sound signal is received and processed by an application executing on a computing hardware component (such as a computing hardware device or processor), whereby the application transforms the changing, or static, sound signal into a changing, or static, visual pattern displayed on a display surface in real time.

FIGS. 1 through 6 wherein like parts are designated by like reference numerals throughout, illustrate an example embodiment or embodiments of a system, device and method of transforming a progressing sound signal into a progressing visual pattern that represents, perceptibly and recognizably, the progressing sound signal. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed in a manner still in keeping with the spirit and scope of the present invention.

Figure 2:
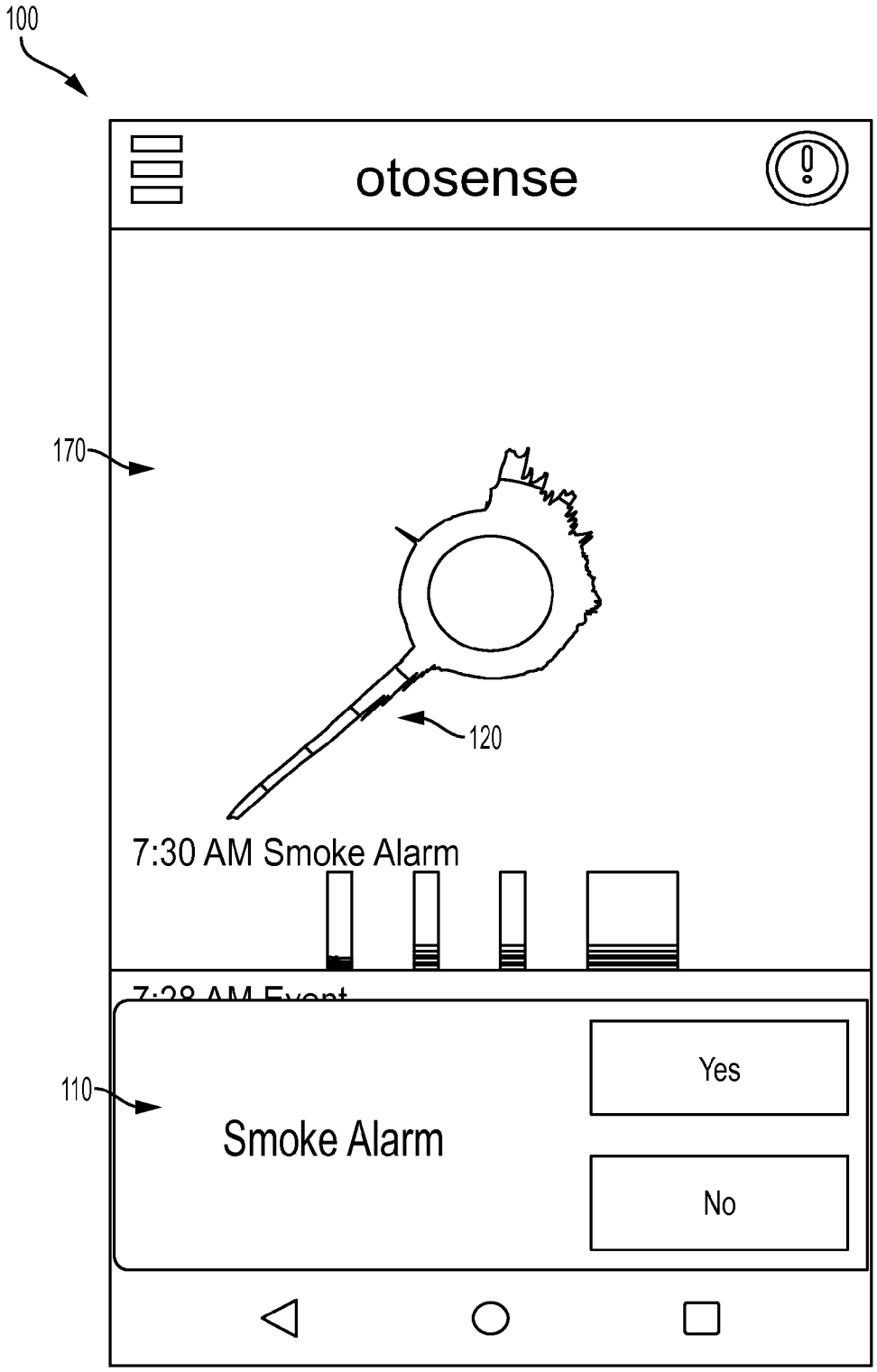
FIG. 2 provides an illustrative example of a snapshot of a progressing visual pattern, in this example, the progressing visual pattern representing the dynamic sound of a specific smoke alarm, where the snapshot is displayed on a screen of a mobile device, according to aspects of the present invention.

FIG. 1 is an example of a snapshot 100 of a progressing visual pattern 120 that can represent a doorbell. The progressing visual pattern 120 derives from a progressing sound signal 110 provided by the doorbell in real time. The snapshot 100 of the progressing visual pattern 120 in FIG. 1 displays visually a set of preselected optical attributes 405. For example, one optical attribute 400 in the set of preselected optical attributes 405 can be a shape having a dimension such as a circle having a radius, a color having a color level, an opacity having a transparency-level and/or another visually perceptible and recognizable optical attribute 400. According to aspects of the present invention, each optical attribute 400 can characterize a specific preselected aspect (such as a sound feature 300, see for example FIG. 4) of the progressing sound signal 110 of the doorbell. FIG. 2 is an example of a snapshot 100 of a progressing visual pattern 120 transformed from the progressing sound signal 110 provided by a smoke alarm.

According to aspects of the present invention, representations of the incoming progressing sound signal 110 can be scaled and modulated over space, time, and a dynamic range on a surface 170, display or screen, herein used interchangeably, such that the representations are compatible with human perception and recognition. According to aspects of the present invention, a set of preselected sound features 305 and a set of preselected optical attributes 405 can be, but need not be, selected using experimental methodologies in order to attain features and attributes that are perceptible and recognizable to one or a plurality of users. According to aspects of the present invention, the set of preselected sound features 305 is transformed into the set of preselected optical attributes 405 using a set of preselected values 355.

Perceivable and perceptible are utilized herein. As one of skill in the art will appreciate, while perceivable pertains to attaining awareness or understanding of [and/or] to become aware of through the senses, perceptible refers to an object or behavior of an object that is able to be seen, noticed, or perceived. Perceptible applies to what can be discerned by the senses often to a minimal extent.

Recognizable is used herein as an adjective describing what can be recognized or what can be perceived as corresponding to and/or representing something and/or someone, and/or what can be perceived as something and/or someone previously identified or known. Recognizable can describe a definite object or behavior of an object such that a user would respond to or take notice of it in some anticipated or known way.

According to aspects of the present invention, the progressing visual pattern 120 can be displayed on the surface 170 of a computing hardware component. As shown in FIGS. 1 and 2, the surface 170 can be a display screen on a mobile device and can include a graphical user interface (GUI). The GUI can deliver and display a prompt for input to a user, receive input from the user, and deliver output to the surface 170 about the progressing visual pattern 120.

As one of skill in the art will appreciate, the surface 170 of the computing hardware component can be configured on one or more of a plurality of mobile and/or stationary devices. One or any combination of these devices can be in communication with a user and/or in communication with a computing hardware device. One or any combination of these devices can be proximal to or remote from the computing hardware component and can be proximal to or remote from the user. The surface 170 can be physically distal, for example, from the computing hardware component executing the application. The progressing visual pattern 120 can be projected, for example, via a projection apparatus onto a distal surface. The computing hardware component can also be configured on a remote server. The surface 170 on which the progressing visual pattern 120 is displayed can be a flat panel display, a liquid crystal display, a light emitting diode (LED) array display, or one or more of any number of surface displays that can display the progressing visual pattern. The device or devices can include, but are not limited to, a mobile phone, a personal computer, one of any number of wearable devices including but not limited to a helmet (for example on the periphery), a visor, a pair of glasses, a ceiling wall or other structural surface, and/or a toy or educational apparatus, e.g., for engaging a baby or child in learning and play.

In an embodiment of the present invention, a method is provided for transforming a progressing sound signal 110 into a progressing visual pattern 120 and displaying the progressing visual pattern 120 on a surface 170. One of a plurality of snapshots (continuous or sequential) in time of the progressing visual pattern 120 is shown in FIGS. 1 and 2.

Figure 3:
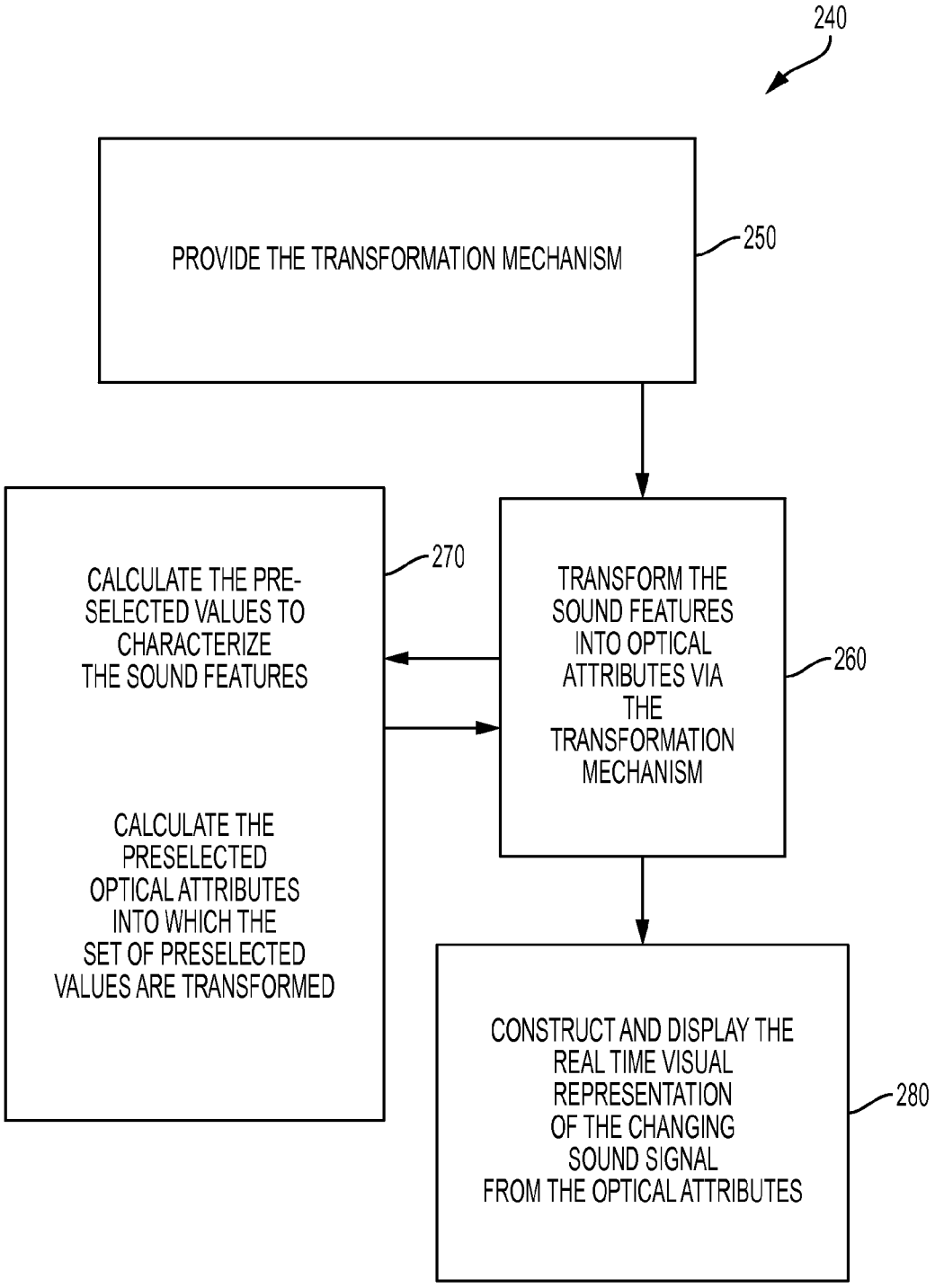
FIG. 3 provides a flow diagram illustrating a method of converting a progressing sound signal over a duration of time into a progressing visual pattern for display in real time on a surface such as that of the screen of a mobile device, according to aspects of the present invention.

FIG. 3 provides a flow diagram illustrating a method 240 for converting a progressing sound signal 110 into a progressing visual pattern 120 for display in real time on a surface 170, according to aspects of the present invention. To perform the transformation, a transformation mechanism is pre-constructed, defined and provided (step 250). The transformation mechanism provides for an isomorphic transformation of the progressing (or static) sound signal 110 into the progressing (or static) visual pattern 120, thereby producing the real time visual representation of the progressing sound signal 110 from the set of optical attributes 405. The transformation mechanism provides a framework for defining the set of preselected values 355 and for transforming the set of preselected sound features 305 into the set of preselected optical attributes 405. The transformation can be executed on a computing hardware device (using the transformation mechanism), thereby transforming (step 260) the set of sound features 305 into the set of optical attributes 405 and thereby transforming the progressing sound signal 110 into the progressing visual pattern 120.

Each sound feature 300 in the set of sound features 305 can be represented formulaically and/or numerically in terms of one or more preselected values 350. The set of preselected values 355 characterizing the set of sound features 305 can be extracted and calculated from the progressing sound signal 110. The set of preselected optical attributes 405 into which the set of preselected values 355 are transformed can be calculated (step 270). The preselected values 355 can be extracted in real time from the progressing sound signal 110. Each preselected sound feature 300 in the set of preselected sound features 305, each optical attribute 400 in the set of preselected optical attributes 405, and each preselected value 350 in the set of preselected values 355 can be selected and constructed formulaically so that individually and/or in combination the preselected sound features 300 are perceptible and recognizable to a hearing user, the preselected optical attributes 400 are perceptible and recognizable to a seeing person, and the existence of an equivalency (e.g. a predictable reproducible relationship, an isomorphic mapping, and/or a consistent correlation) between each sound feature 300 and each optical attribute 400 alone and/or in combination is recognizable to a user. A real time visual representation of the progressing sound signal 110 can be constructed from the optical attributes 405 (step 280) and displayed on a display surface 170.

FIG. 4 shows examples of preselected values 350, according to aspects of the present invention, where one preselected value 350 can transform one preselected sound feature 300 into one preselected optical attribute 400, as shown. Thus, in aggregate, the set of preselected values 355 transform the progressing sound signal 110 into a progressing visual pattern 120. Each sound feature 300 can be preselected to be generally perceptible and recognizable to a user. For example, a sound feature could comprise a rhythm, a pitch, or another characteristic feature of sound. A set of specific metrics for perceptibility and recognizability can also be established, for example experimentally, using a large group of users, as one of skill in the art will appreciate. As one of skill will appreciate, perceptible and recognizable can also be established by an indication or affirmation by at least one user of what that at least one user can perceive and recognize as representing and/or corresponding to something else, something that may be previously known in the same, similar, or a completely different embodiment or form.

According to aspects of the present invention, a set of preselected values 355 can transform a set of preselected sound features 305 into a set of preselected optical attributes 405. According to aspects of the present invention, a preselected value 350 can transform one preselected sound feature 300 of the set of preselected sound features 305 into one optical attribute 400 of the set of preselected optical attributes 405. One of skill will recognize that a plurality of combinations of preselected values 350 can, but need not, be constructed to transform the progressing sound signal 110 into the progressing visual pattern 120.

Figure 5:
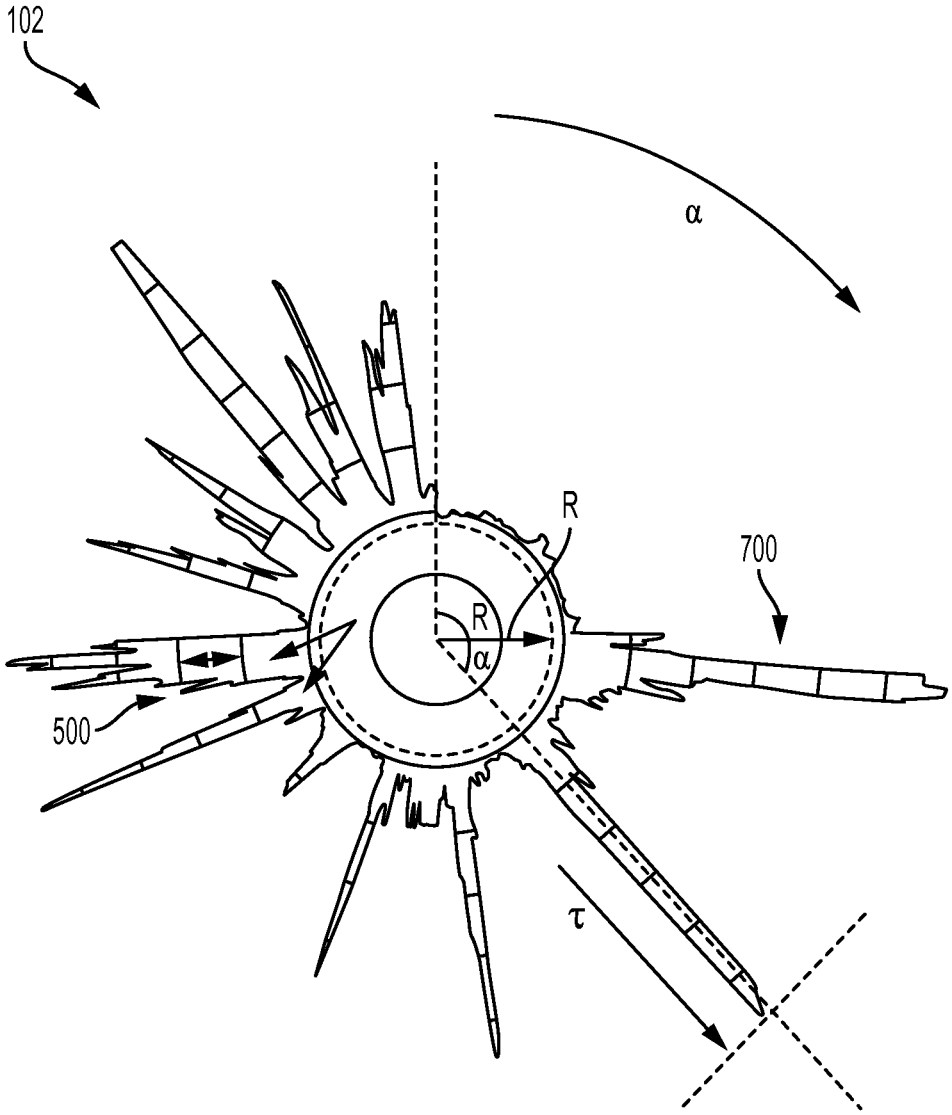
FIG. 5 is a diagram illustrating an example of a transformation mechanism (equivalently referred to as a transformation construct) superimposed on a snapshot of a progressing visual pattern.

FIG. 5 provides an example of a transformation mechanism 102 constructed, according to aspects of the present invention, to provide a basis for defining the set of preselected values 355. The transformation mechanism 102 provides a mapping of one coordinate system (that of the progressing sound signal) into another (that of the progressing visual pattern) and provides a set of polar or other variables (building blocks) for defining the set of preselected values 355 in terms that are common to the set of preselected sound features 305 and the set of preselected optical attributes 405. FIG. 5 shows, for example, a way in which an audio frequency is transformed into a spatial angle. The set of preselected values 355 derived from the progressing sound signal 110 can be mapped into a coordinate system of the progressing visual pattern 120, thereby defining in the preselected coordinate system the set of preselected values (and the set of optical attributes 405). The coordinate system for representing the optical attributes 405 and progressing visual pattern 120 can be a polar coordinate system, as shown in FIG. 5.

The set of variables, for example those depicted in FIG. 5, define the set of preselected values 355 (a formulaic relationship constructed from the variables having also a numerical quantity that can be extracted and calculated from the progressing sound signal), according to aspects of the present invention.

According to aspects of the present invention, the set of preselected values 355 can produce an isomorphic relationship between each preselected sound feature 300 and each preselected optical attribute 400. The set of preselected values 355 can produce an isomorphic relationship between the set of preselected sound features 305 and the set of preselected optical attributes 405. Each preselected value 350 or set of preselected values 355 can isomorphically transform the progressing sound signal 110 into the progressing visual pattern 120 displayed on surface 170 such that the progressing visual pattern 120 and a snapshot 100 of a progressing visual pattern 120 can be visually perceived, recognized, and identified as the progressing sound signal (or a sound event) by a user.

According to aspects of the present invention, the transformation mechanism 102 provides a basis for a creating a spectrum dependent perceptible and recognizable visual representation of the progressing sound signal 110. The transformation mechanism 102 can relate sound intensity to a radius R of a circle visible on a display surface 170, an "intensity circle" or, equivalently, a "base circle". The center of the polar coordinate system can be positioned at the center of the intensity circle or an alternative circular shape or disc. The center of the "intensity circle" can be proximal to a specific (central or centered) position on a portion of the surface 170 displaying the progressing visual pattern 120. The radius R of the circle can be proportional to the logarithm of the time averaged power spectrum of the progressing sound signal 110 (the base circle radius, R, can represent an averaged logarithm of intensity). The circle size, defined by R, can be scaled such that a minimum radius of the intensity circle, for example, is 10% of the width of the display surface 170.

One of skill in the art will appreciate that one and/or more than one coordinate system can be used, alone and/or in combination, to create an isomorphic transformation between a set of sound features 305 and a set of optical attributes 405, according to aspects of the present invention.

In order to transform a progressing sound signal 110 into a progressing visual pattern 120 displayed on a surface such that the progressing visual pattern 120 (and contributing set of optical attributes 405) is perceptible, recognizable and interpretable as representing the progressing sound signal 110, the set of preselected values 355 can be constructed to capture and reflect specific aspects of human perception and recognition. Although used interchangeably herein, one of skill in the art will appreciate that perceivability pertains largely to the ability of a user to decipher/resolve sensory stimulae, while cognition, recognition and interpretation pertain largely to the ability of a user to associate sensory stimulae with something known to the user and to understand a meaning of the sensory stimulate.

According to aspects of the present invention, in order to avoid retinal persistence and reduce the impact of signal noise on perception of the progressing visual pattern 120, a preselected value 350 can comprise a time averaged windowed portion of the spectrum of the progressing sound signal 110. A particular windowed portion of the spectrum of the progressing sound signal 110 can be preselected to highlight portions of information in the progressing sound signal 110 that are most perceptible (and perceivable to a plurality of human users). A logarithmic range of the spectrum of the progressing sound signal 110 can be used to capture the logarithmic sensitivity of the inner ear and of human audition to sound. A logarithmic scale can be used to represent a preselected value 350, because, for example, user sensitivity to pitch and other sound features 300 is, generally, logarithmic. A first derivative of a logarithmic spectra can be preselected when a change in a sound feature 300 of the progressing sound signal 110 is important for communicating information about the progressing sound signal 110 to the user. A first derivative of a log-spectrum can be displayed in polar coordinates on the display screen at a speed that avoids perception of a blurred motion and on a logarithmic scale to reflect the logarithmic sensitivity of a user to acoustic frequencies and to acoustic power at each frequency. A logarithmic scale also accentuates the progressive insensitivity of a user to sounds that do not change over time. By accounting for such aspects of human perception and recognition, a time averaged windowed portion of a logarithmic spectrum of the progressing sound signal 110 can be preselected, according to aspects of the present invention, to transform, via the transformation mechanism 102, a set of preselected sound features 305 into a set of preselected optical attributes 405, with the transformation mechanism 102 providing the basis for defining the set of preselected values 355 in terms of variables and a coordinate system selected for optimal user perceivability and recognition of the displayed progressing visual pattern 120. One of skill in the art will appreciate that other transformation mechanisms constructed to conform with user perceivability and recognition can be provided and utilized to transform the progressing sound signal 110 into the progressing visual pattern 120 displayed on a surface 170.

According to aspects of the present invention, rhythm such as intensity of a rhythm can be a preselected sound feature 300 since human audition is very sensitive to rhythm. According to aspects of the present invention, a color and/or a pattern of a shape in the progressing visual pattern 120 can be associated with a rhythm in the progressing sound signal 110 to enhance a representation of rhythm in the progressing visual pattern 120 representing the progressing sound signal. According to aspects of the present invention, a spatial frequency 500 of the progressing visual pattern 120 can be proportional linearly, or otherwise, (e.g. linked) to an audio-signal intensity rhythm or a signature rhythmic element in the intensity spectrum of the progressing sound signal 110.

Linear, inverse, or alternative relationships between a sound feature 300 and an optical attribute 400, which can be defined by a preselected value 350 or set of preselected values 355, are used to construct an isomorphic relationship between a sound feature 300 and an optical attribute 400. Numerical quantities for each preselected value 350 over a time interval can be calculated (and can be extracted continuously) from the progressing sound signal 110 in real time. According to an embodiment of the present invention, a numerical value can be calculated for each optical attribute 400 in the set of preselected optical attributes 405. In an alternative embodiment of the present invention, a numerical value can be calculated for each sound feature 300 in the set of preselected sound features 305 in addition to or in lieu of being calculated for each optical attribute 400 in the set of preselected optical attributes 405.

FIG. 5 illustrates an example of an isomorphic transformation, according to aspects of the present invention. Transparency can be proportional to an inverse of the logarithm of the averaged intensity spectrum of the progressing sound signal 110. Intensity of the progressing sound signal 110 can be represented by transparency, with transparency defined in terms of an angle $\alpha$ in FIG. 5. A numerical quantity for the transparency level can be extracted and calculated in real time from the progressing sound signal 110. According to aspects of the present invention, the averaged intensity at an instant in time corresponds to the intensity averaged over, for example, the 3 seconds prior to and including the instant in time, in other words, the three 3 second moving average of the intensity. The progressing sound signal 110 can be processed (for example averaged) over a time interval of 3 seconds to eliminate at least a portion of the noise associated with the progressing sound signal 110. One of skill in the art will recognize that a plurality of time durations and a plurality of processing operations can be used to improve the quality of the progressing sound signal 110.

According to aspects of the present invention, the progressing visual pattern 120 displayed on a surface 170 (and a snapshot 100 of a visual representation captured from the progressing visual pattern 120) observes a number of basic rules of isomorphism. An example of such a basic rule of isomorphism can be that a null level for a preselected sound feature 300 corresponds to a null level for a preselected optical attribute 400. According to aspects of the present invention, a null intensity over a time period can correspond with silence (or background noise) over the same or a consistently comparable time period. A pure static sound can disappear visually, being no longer perceptible, in about 10 seconds. By constructing an isomorphic transformation mechanism, a visual stimulus directed to a user is analogous in specific domains to an auditory stimulus directed to a user, thus being, for example, recognizably related.

According to aspects of the present invention, each optical attribute in the set of optical attributes 405 can be scaled and normalized to be perceptible. For example, each point of the "intensity circle" can be represented by polar coordinates, with a vertical axis as the polar axis, and a dimension of screen width normalized to a distance of unity. Each angle $\alpha$ can represent a frequency $f(\alpha)$. A minimum frequency, $f(0)$, and a maximum frequency, $f(2\pi)$ can be mapped onto a circumference of the "intensity circle", with, for example, $f(0)=f_{min}=100$ Hz, $f(2\pi)=f_{max}=8000$ Hz. A log-spectrum can be linearly mapped from $f_{min}$ to $f_{max}$ between $\alpha$ angles of 0 and $2\pi$. The polar coordinate system representation can additionally be scaled and normalized according to the capacity of a typical user's visual perceivability.

According to aspects of the present invention, to represent the spectrum, a polygon can be created where, for each angle $\alpha$ (defined in discrete quantities with a $\pi/600$ increment), a vertex of the polygon can be added to the progressing visual pattern, the vertex being represented in polar coordinates by angle $\alpha$ and a radial coordinate $\xi$ equal to or proportional to a numerical quantity associated with the radius R plus a spectral variation (such as power change) at $f(\alpha)$, where R is the radius of the "intensity circle" and $f(\alpha)$ represents a spectral frequency at angle $\alpha$. One of skill will appreciate that any number of transformative relationships and values can be preselected and used to execute the application on a computing hardware component of a device.

According to aspects of the present invention, an autocorrelation function can be constructed that optimizes an autocorrelation quantity that can be calculated from an intensity variation of at least a portion of the progressing sound signal 110. When the autocorrelation quantity is greater or equal to a threshold or set point value, for example approximately 0.4 (or 40%), a periodicity 700 in the progressing visual pattern 120 can be recognizable and perceptible.

According to aspects of the present invention, a signal intensity variation can be tracked (for example over the 3 last seconds of the progressing sound signal 110) and can be modeled as an "intensity array", an array of, for example, 256 values. An autocorrelation of this intensity array can be calculated, resulting in a number, AC, that can be constrained to be between 0 (no autocorrelation) and 1 (perfect autocorrelation). A correlation function is computed between this intensity array and itself, shifted by an integer S, where S varies in quantitative value from 0 to 255. A series of correlation values AC(S) can thus be constructed, and a value, $S_{max}$ (S) that maximizes AC(S) can be obtained. According to aspects of the present invention, a polar shader linked to the value of AC and $S_{max}$ can fill the shape. This is just one example of a progressing visual pattern and a method for displaying a progressing visual pattern that is constructed to be commensurate with human perception.

According to aspects of the present invention, if AC<0.4, the polar shader can have a radius R equal to the screen width, a central color set to RGB (0, 255AC, 50) and a peripheral color set to RGB (0, 255, 255). According to aspects of the present invention, if AC>0.4, the polar shader radius r can be set to $S_{max}$ with a starting color at r=0 of RGB (0, 255AC, 50) and an ending color at r modulo $S_{max}$ $=S_{max}$ RGB (0, 255, 255) This is just another example of the types of methods that can be used to normalize and scale the progressing visual pattern for human perception. One of skill in the art will appreciate that alternative methods and transformation mechanisms can be designed and applied to render a progressing visual pattern 120 displayed on a surface 170 that is perceptible and recognizable to a user.

One of skill in the art will appreciate that a number of different embodiments of transforming rhythmic features of a sound signal into scaleable optical attributes 405 of a progressing visual pattern 120 can be identified and deployed in order that a progressing sound signal 110 can be visually recognizable and perceptible in the form of a progressing visual pattern 120 to a user.

In accordance with an embodiment of the present invention, metrics for perceptibility and recognizability can be attained by performing, for example, tests of perceptibility and recognizibility of the progressing visual pattern 120 and of a snapshot 100 of the progressing visual pattern 120 using human test subjects. Experimental tests in which a plurality of users identify each preselected sound feature 300, the set of preselected sound features 305, each preselected value 350, the set of preselected values 355, each optical attribute 400 and the set of preselected optical attributes 405, separately and in combination with each other and the progressing visual pattern 120, can also be performed to guide the selection of each preselected sound feature 300, the set of preselected sound features 305, each preselected value 350, the set of preselected values 355, each optical attribute 400 and the set of preselected optical attributes 405. One of skill in the art will appreciate that a user can be trained actively and/or passively, to perceive, recognize and interpret a progressing visual pattern displayed on a surface.

Figure 6:
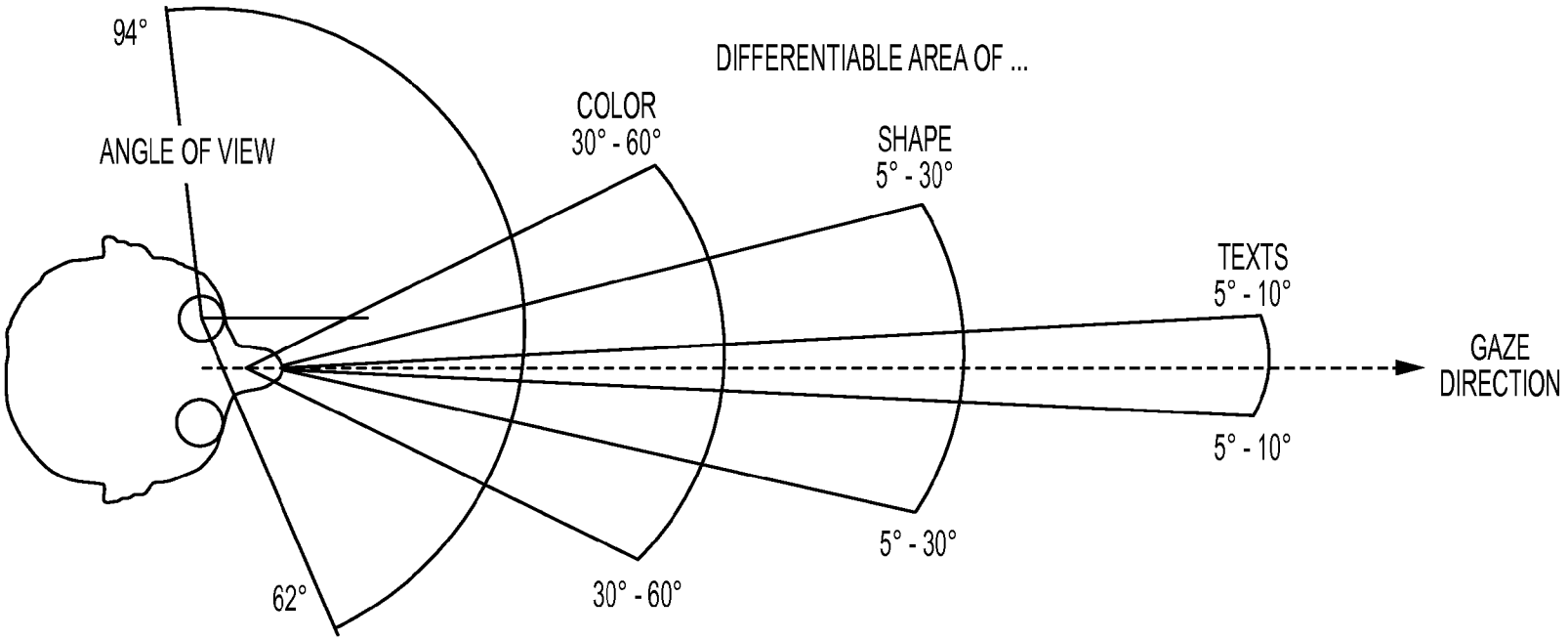
FIG. 6 provides an example of a constructive characterization of human perception that can be used to configure the spatial arrangements of information in the progressing visual pattern displayed on the surface, or to configure the spatial location and disposition of the surface displaying the progressing visual pattern relative to a user's gaze such that the progressing visual pattern is perceptible to a user.

FIG. 6 illustrates an aspect of human cognition that can be used to inform the preselection of each preselected value 350 in the set of preselected values 355 in order to attain perceptible and recognizable optical attributes 405 and changes in optical attributes 405 with time. The aspect of human cognition illustrated relates to an optimal or near optimal field of view for transferring certain kinds of information to a user.

Additionally, one of skill in the art will appreciate that the progressing visual pattern 120 that results from a specific progressing sound signal 110 can be different, depending, for example, on the type of surface 170 or device displaying the progressing visual pattern, at least because the physical arrangement of the surface 170 displaying the progressing visual pattern 120 with respect to a user will be different depending on the device type.

According to aspects of the present invention, a disposition of a surface 170 displaying the progressing visual pattern 120 in relation to a user (and a disposition of information within the progressing visual pattern 120 (on the surface 170) is selected so that the progressing visual pattern 120 (and specific optical attributes 405 of the progressing visual pattern) fits entirely within a central field of view of a user. Human spatial discrimination is at a maximum within a central 20 degree field of view. According to aspects of the present invention, the progressing visual pattern 120 can be disposed on a surface disposed in relation to a user such that the progressing visual pattern 120 fits entirely within 20 degrees of a user's central field of view.

Additionally, for example, a range of orientations of user gaze relative to a surface 170 normal of a display screen surface 170 can highlight and distinguish certain types of information for a user. The angular range relative to the direction of a user's gaze in which text information can be disposed can be selected for optimal perceptibility of this information. The angular range can be defined by a cone disposed within 10 degrees of the direction of the gaze of a user, according to aspects of the present invention. For a user to differentiate additional optical attributes 405 and changes in optical attributes 405, the display surface 170 can display optical attributes 405 and numerical values defining a level of the optical attribute such as color and shape within cones disposed to optimize color and shape perception, according to aspects of human cognition as shown in FIG. 6.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall there between.

What is claimed is:

1. A method comprising:

transforming a progressing sound signal into a progressing visual pattern displayed on a surface over a time duration by executing, on a computing hardware component, an application implementing a plurality of steps, the steps comprising:

calculating from the progressing sound signal a set of preselected values, the set of preselected values being represented formulaically and/or numerically and characterizing a set of preselected sound features from which the progressing sound signal can be reconstructed to be recognizable; and transforming the set of preselected sound features into a set of preselected optical attributes, wherein the set of preselected optical attributes defines the progressing visual pattern displayed on the surface, wherein transforming comprises mapping the set of preselected values into a coordinate system of the progressing visual pattern thereby defining numerical values for the set of optical attributes defining the progressing visual pattern; and the computing hardware component causing display of the progressing visual pattern on the surface;

wherein the progressing visual pattern is displayed in a form that is isomorphic to sound, perceptible to human vision, can be processed by human cognition, and which is therefore recognizable to a human during the time duration.

2. The method of claim 1, wherein the set of preselected values transforms one of the set of preselected sound features into one of the set of preselected optical attributes, and wherein an equivalency between the one preselected sound feature and the one preselected optical attribute is displayed in a recognizable form to a user viewing the display of the progressing visual pattern on the surface.

3. The method of claim 1, wherein each preselected value in the set of preselected values transforms one of the set of preselected sound features into one of the set of preselected optical attributes, and wherein an equivalency between the one preselected sound feature and the one preselected optical attribute is recognizable to a user viewing the display of the progressing visual pattern on the surface.

4. The method of claim 1, wherein transforming the progressing sound signal into the progressing visual pattern for display occurs in real time.

5. The method of claim 1, wherein the progressing sound signal comprises an aperiodic portion.

6. The method of claim 1, wherein one feature of the set of preselected sound features is a volume quantity and a preselected value associated with the volume quantity is a user-perceptible loudness, calculated as a log of the averaged power spectrum of the sound signal over an interval of time.

7. The method of claim 1, wherein one feature of the set of preselected sound features is a pitch indication, and a preselected value associated with the pitch indication is a frequency level, calculated as the log of the average frequency spectrum of the sound signal over an interval of time.

8. The method of claim 1, wherein one feature of the set of preselected sound features is a rhythm indication, and a preselected value associated with the rhythm indication is an intensity variation quantity, calculated as a first derivative of the log of the averaged intensity of the sound signal over an interval of time.

9. The method of claim 1, wherein one attribute of the set of preselected optical attributes is a shape indication, and a preselected value associated with the shape indication defines a linear dimension.

10. The method of claim 1, wherein one attribute of the set of preselected optical attributes is a transparency indication, and a preselected value associated with the transparency indication defines a level of transparency.

11. The method of claim 1, wherein the surface comprises one or more surface of a plurality of surfaces selected from the group consisting of a flat panel display, a liquid crystal display, a diode array display, a display screen, a mobile phone surface, a personal computer surface, a surface of a helmet, a visor, a pair of glasses, an apparatus for engaging an infant, or any other type of display surface that can be oriented in view of a user.

12. The method of claim 1, wherein the computing hardware component comprises one or more display device of a plurality of display devices selected from the group consisting of a mobile phone, a personal computer, a helmet, a visor, a pair of glasses, a display screen, a display surface, and an apparatus for engaging an infant.

13. The method of claim 1, wherein the progressing visual pattern is displayed on the surface in real time.

14. The method of claim 1, wherein the progressing visual pattern is recognizable by a human who has been exposed and actively or passively trained to the progressing visual pattern.

15. A device comprising:

a surface displaying a progressing visual pattern transformed from a progressing sound signal over a time duration;

a computing hardware component configured in communication with the surface displaying the progressing visual pattern;

an application executing on the computing hardware component, transforming the progressing sound signal into the progressing visual pattern displaying on the surface;

wherein a set of preselected values is calculated by the executing application, the set of preselected values being represented formulaically and/or numerically and characterizing a set of preselected sound features from which the progressing sound signal can be reconstructed to be recognizable;

wherein the set of preselected sound features is transformed into a set of preselected optical attributes, wherein the transforming comprises mapping the set of preselected values into a coordinate system of the progressing visual pattern thereby defining numerical values for the set of optical attributes defining the progressing visual pattern;

wherein the set of preselected optical attributes defines the progressing visual pattern, and wherein the progressing visual pattern is displayed in a form that is isomorphic to sound, perceptible to human vision, can be processed by human cognition, and which is therefore recognizable to a human during the time duration.

16. The device of claim 15, wherein the set of preselected values transforms one of the set of preselected sound features into one of the set of preselected optical attributes, and wherein an equivalency between the one preselected sound feature and the one preselected optical attribute is recognizable to a user viewing the display of the progressing visual pattern on the surface.

17. The device of claim 15, wherein each preselected value in the set of preselected values transforms one of the set of preselected sound features into one of the set of preselected optical attributes, and wherein an equivalency between the one preselected sound feature and the one preselected optical attribute is recognizable to a user viewing the display of the progressing visual pattern on the surface.

18. The device of claim 15, wherein the transformation of the progressing sound signal into the progressing visual pattern occurs in real time.

19. The device of claim 15, wherein the progressing sound signal comprises an aperiodic portion.

20. The device of claim 15, wherein one feature of the set of preselected sound features is a volume quantity and a preselected value associated with the volume quantity is a user-perceptible loudness, calculated as a log of the averaged power spectrum of the sound signal over an interval of time.

21. The device of claim 15, wherein one feature of the set of preselected sound features is a pitch indication, and a preselected value associated with the pitch indication is a frequency level, calculated as the log of the average frequency spectrum of the sound signal over an interval of time.

22. The device of claim 15, wherein one feature of the set of preselected sound features is a rhythm indication, and a preselected value associated with the rhythm indication is an intensity variation quantity, calculated as a first derivative of the log of the averaged intensity of the sound signal over an interval of time.

23. The device of claim 15, wherein one attribute of the set of preselected optical attributes is a shape indication, and a preselected value associated with the shape indication defines a linear dimension.

24. The device of claim 15, wherein one attribute of the set of preselected optical attributes is a transparency indication, and a preselected value associated with the transparency indication defines a level of transparency.

25. The device of claim 15, wherein the surface comprises one or more surface of a plurality of surfaces selected from the group consisting of a flat panel display, a liquid crystal display, a diode array display, a display screen, a mobile phone surface, a personal computer surface, a surface of a helmet, a visor, a pair of glasses, an apparatus for engaging an infant, or any other type of display surface that can be oriented in view of a user.

26. The device of claim 15, wherein the computing hardware component comprises one or more device of a plurality of devices selected from the group consisting of a mobile phone, a personal computer, a helmet, a visor, a pair of glasses, a display screen, and an apparatus for engaging an infant.

27. The device of claim 15, wherein a visual representation of each one of the set of preselected optical attributes displayed on the surface is recognizable to a user as representing a preselected sound feature in a set of preselected sound features.

28. The device of claim 15, wherein the progressing visual pattern is displayed on the surface in real time.

29. The device of claim 15, wherein the device is a distributed device, the distributed device having components that may be separated by physical distances from each other.

30. The device of claim 15, wherein the progressing visual pattern is recognizable by a human who has been exposed and actively or passively trained to the progressing visual pattern.

31. A device comprising:

a display surface displaying a progressing visual pattern transformed from a progressing sound signal;

a computing hardware component;

an application executing on the computing hardware component;

wherein the computing hardware component is configured in communication with the surface;

wherein a set of pre-determined values are extracted by the application from the progressing sound signal, the set of pre-determined values being resented formulaically and/or numerically and characterizing a set of preselected sound features from which the progressing sound signal can be reconstructed to be recognizable;

wherein each one of the set of pre-determined values extracted from the progressing sound signal transforms one preselected sound feature of the set of preselected sound features into one pre-selected optical attribute of a set of pre-selected optical attributes, wherein the transforming comprises mapping the set of pre-determined values into a coordinate system of the progressing visual pattern thereby defining numerical values for the set of pre-selected optical attributes defining the progressing visual pattern;

wherein the set of pre-selected optical attributes define the progressing visual pattern displayed on the display surface; and wherein the progressing visual pattern is displayed in a form that is isomorphic to sound, perceptible to human vision, can be processed by human cognition, and which is therefore recognizable to a human during the time duration.

32. The device of claim 31, wherein the progressing visual pattern is recognizable by a human who has been exposed and actively or passively trained to the progressing visual pattern.

* * * * *